US010602261B2

(12) United States Patent
Kang et al.

(10) Patent No.: US 10,602,261 B2
(45) Date of Patent: Mar. 24, 2020

(54) DIRECTIONAL MICROPHONE

(71) Applicant: SAMSUNG ELECTRONICS CO., LTD., Suwon-si (KR)

(72) Inventors: Sungchan Kang, Hwaseong-si (KR); Cheheung Kim, Yongin-si (KR); Sangha Park, Seoul (KR); Yongseop Yoon, Seoul (KR); Choongho Rhee, Anyang-si (KR); Hyeokki Hong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/127,565

(22) Filed: Sep. 11, 2018

(65) Prior Publication Data

US 2019/0200119 A1 Jun. 27, 2019

(30) Foreign Application Priority Data

Dec. 27, 2017 (KR) ..... 10-2017-0181524

(51) Int. Cl.

| | |
|---|---|
| ***H04R 1/34*** | (2006.01) |
| ***H04R 7/04*** | (2006.01) |
| ***H04R 1/04*** | (2006.01) |
| ***H04R 17/02*** | (2006.01) |
| ***H04R 23/00*** | (2006.01) |
| ***H04R 17/10*** | (2006.01) |

(52) U.S. Cl.

CPC ..... *H04R 1/342* (2013.01); *H04R 1/04* (2013.01); *H04R 7/04* (2013.01); *H04R 17/02* (2013.01); *H04R 17/10* (2013.01); *H04R 23/006* (2013.01)

(58) Field of Classification Search

None

See application file for complete search history.

(56) References Cited

U.S. PATENT DOCUMENTS

| | | | | |
|---|---|---|---|---|
| 5,856,722 | A | 1/1999 | Haronian et al. | |
| 6,651,504 | B1 | 11/2003 | Datskos | |
| 8,331,600 | B2 | 12/2012 | Suzuki | |
| 8,724,839 | B2 | 5/2014 | Harano et al. | |
| 9,516,421 | B1 * | 12/2016 | Loeppert | H04R 17/02 |
| 2009/0079298 | A1 | 3/2009 | Park et al. | |
| 2009/0140612 | A1 * | 6/2009 | Ikeuchi | G01H 3/08 310/348 |
| 2017/0374441 | A1 * | 12/2017 | Hoekstra | B81C 1/00309 |
| 2018/0038901 | A1 | 2/2018 | Kim et al. | |

FOREIGN PATENT DOCUMENTS

| | | | |
|---|---|---|---|
| EP | 2 986 024 | A1 | 2/2016 |
| JP | 9-84171 | A | 3/1997 |
| JP | 3353728 | B2 | 12/2002 |

(Continued)

OTHER PUBLICATIONS

Communication dated Apr. 10, 2019, issued by the European Patent Office in counterpart European Application No. 18194340.8.

*Primary Examiner* — James K Mooney

(74) *Attorney, Agent, or Firm* — Sughrue Mion, PLLC

(57) ABSTRACT

A directional microphone is provided which includes a substrate having a cavity that penetrates therethrough, a resonator array of at least one resonator, and a cover member. Each of the resonator array and the cover member covers covering at least a part of the cavity.

15 Claims, 19 Drawing Sheets

(56) References Cited

FOREIGN PATENT DOCUMENTS

| | | | |
|---|---|---|---|
| JP | 2009111702 | A | 5/2009 |
| JP | 2010245994 | A | 10/2010 |
| KR | 1020120063505 | A | 6/2012 |
| KR | 1020180015482 | A | 2/2018 |
| WO | 2012/145278 | A2 | 10/2012 |

* cited by examiner

DIRECTIONAL MICROPHONE

CROSS-REFERENCE TO RELATED APPLICATION

This application claims priority from Korean Patent Application No. 10-2017-0181524, filed on Dec. 27, 2017, in the Korean Intellectual Property Office, the disclosure of which is incorporated herein in its entirety by reference.

BACKGROUND

1. Field

Apparatuses consistent with example embodiments relate to a microphone, and more particularly, to a directional microphone having increased sensitivity.

2. Description of the Related Art

Microphones are devices that convert an acoustic signal into an electric signal. Microphones may be used as sensors for recognizing a voice by being attached to mobile phones, household appliances, video display devices, virtual reality devices, augmented reality devices, or artificial intelligent speakers. Recently, a directional microphone having a resonator array of resonators having different center frequencies and arranged on a substrate in which cavity is formed has been developed.

SUMMARY

One or more example embodiments may provide a directional microphone having increased sensitivity.

Additional example aspects and advantages will be set forth in part in the description which follows and, in part, will be apparent from the description, or may be learned by practice of the presented example embodiments.

According to an aspect of an example embodiment, a directional microphone includes a substrate having a cavity that penetrates therethrough, a resonator array comprising at least one resonator and covering a first portion of the cavity, and a cover member covering at least a part of a second portion of the cavity not covered by the resonator array.

The cover member may comprise a thin film form.

One end portion of each of the at least one resonator may be fixed to the substrate.

The at least one resonator may include a fixed portion fixed to the substrate, a movable portion extending from the fixed portion and moveable in response to an acoustic signal, and a sensing portion configured to sense movement of the movable portion.

The cover member may substantially cover an entirety of the second portion of the cavity.

The directional microphone may further include a fixing covering at least a part of the second portion of the cavity, where one end portion of each of the at least one resonator is fixed to the fixed portion.

The fixing member may comprise a thin film and may move in association with the at least one resonator.

The fixing member may include a same material as the resonator.

The fixing member may substantially cover an entirety of the second portion of the cavity.

According to an aspect of another example embodiment, a directional microphone includes a substrate having a cavity that penetrates therethrough, a resonator array comprising at least one resonator and covering a first portion of the cavity, and a fixing member to which one end portion of each of the at least one resonator is and covering at least a part of a second open portion of the cavity not covered by the resonator array.

The fixing member may comprise a thin film and may move in association with the at least one resonator.

The fixing member may substantially cover an entirety of the second portion of the cavity.

The directional microphone may further include a cover member covering at least a part of the second portion of the cavity.

The cover member may comprise a thin film.

The cover member and the fixing member may, together, substantially cover an entirety of the second portion of the cavity.

According to an aspect of another example embodiment, a directional microphone includes a substrate having a cavity that penetrates therethrough, a resonator array comprising at least one resonator and covering a first portion of the cavity, and a filing member covering a second portion of the cavity not covered by the resonator array.

The filling member may substantially cover an entirety of the second portion of the cavity.

The filling member may comprise a fixing member to which one end portion of each of the at least one resonator is fixed and covering at least a part of the second portion of the cavity.

The filling member may further include a cover member covering at least a part of the second portion of the cavity.

BRIEF DESCRIPTION OF THE DRAWINGS

These and/or other example aspects and advantages will become apparent and more readily appreciated from the following description of the example embodiments, taken in conjunction with the accompanying drawings in which.

DETAILED DESCRIPTION

Figure 1:
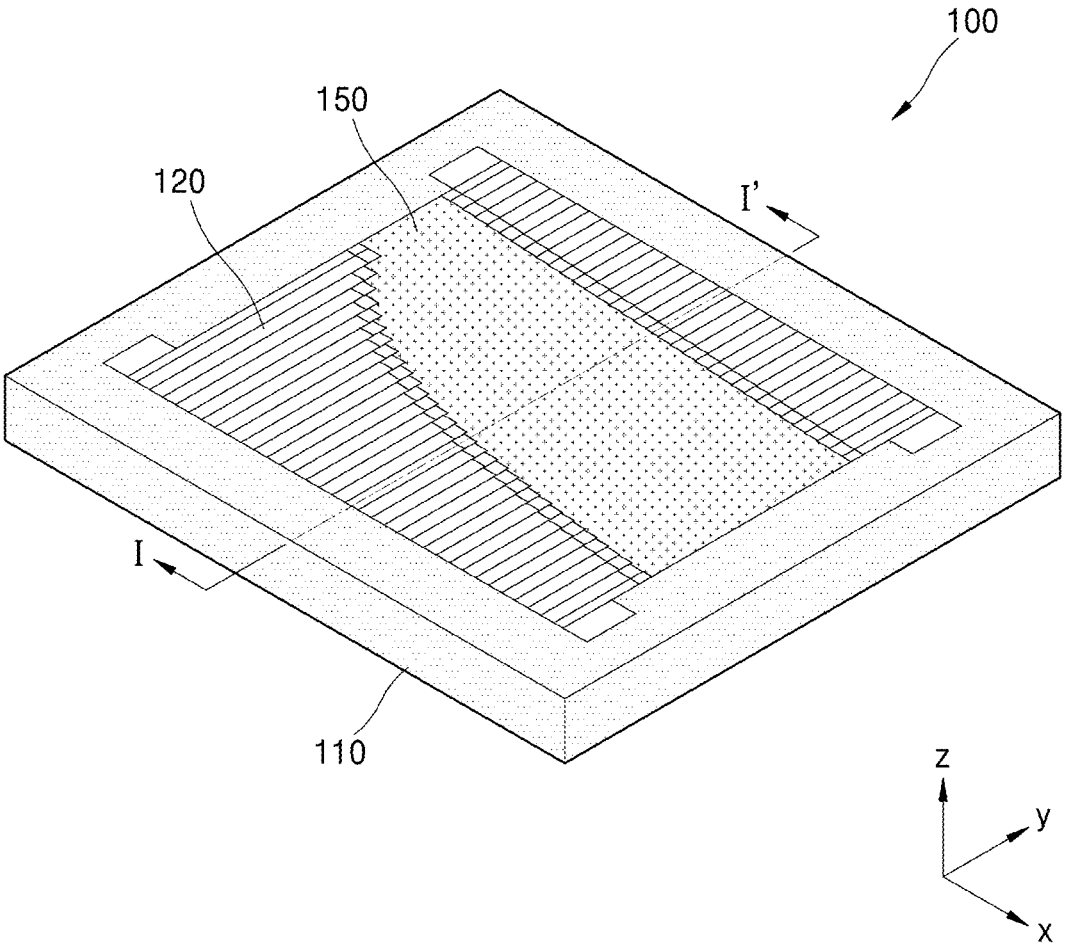
FIG. 1 is a perspective view of a microphone according to an example embodiment.

Reference will now be made in detail to example embodiments, examples of which are illustrated in the accompanying drawings, wherein like reference numerals refer to like elements throughout. Also, the size of each layer illustrated in the drawings may be exaggerated for convenience of explanation and clarity. In this regard, the present embodiments may have different forms and should not be construed as being limited to the descriptions set forth herein.

In the following description, when a constituent element is disposed "above" or "on" to another constituent element, the constituent element may be only directly on the other constituent element or above the other constituent elements in a non-contact manner. As used herein, the singular forms "a," "an" and "the" are intended to include the plural forms as well, unless the context clearly indicates otherwise. It will be further understood that the terms "comprises" and/or "comprising" used herein specify the presence of stated features or components, but do not preclude the presence or addition of one or more other features or components.

The use of the terms "a" and "an" and "the" and similar referents in the context of describing the disclosure (especially in the context of the following claims) are to be construed to cover both the singular and the plural. Also, the steps of all methods described herein can be performed in any suitable order unless otherwise indicated herein or otherwise clearly contradicted by context. The present disclosure is not limited to the described order of the steps. The use of any and all examples, or language (e.g., "such as") provided herein, is intended merely to better illuminate the disclosure and does not pose a limitation on the scope of the disclosure unless otherwise claimed.

Figure 2:
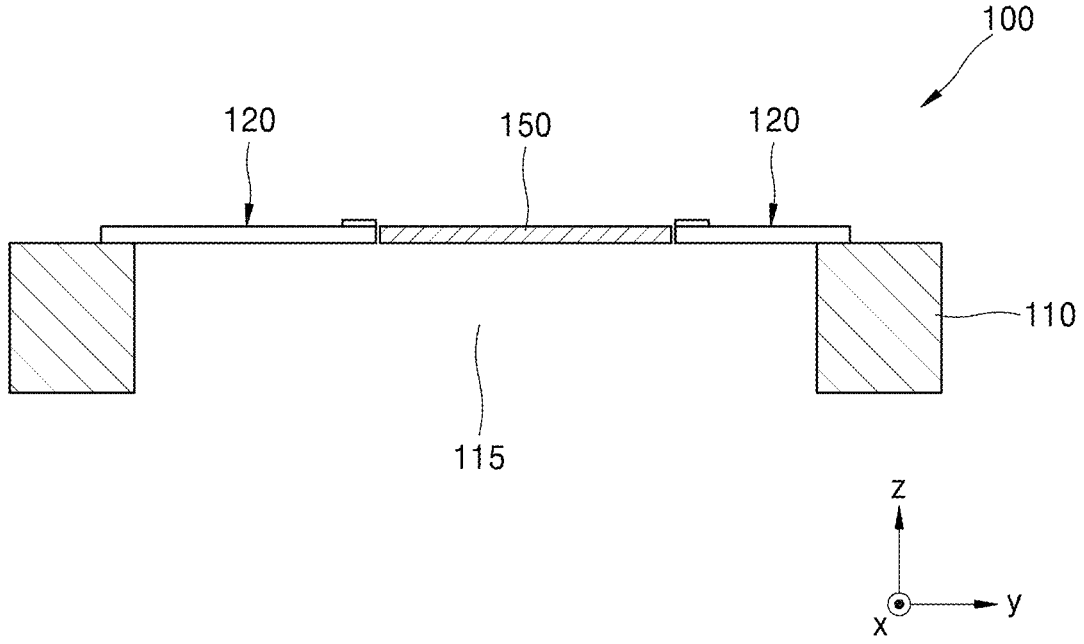
FIG. 2 is a cross-sectional view taken along a line I-I' of FIG. 1.
Figure 3:
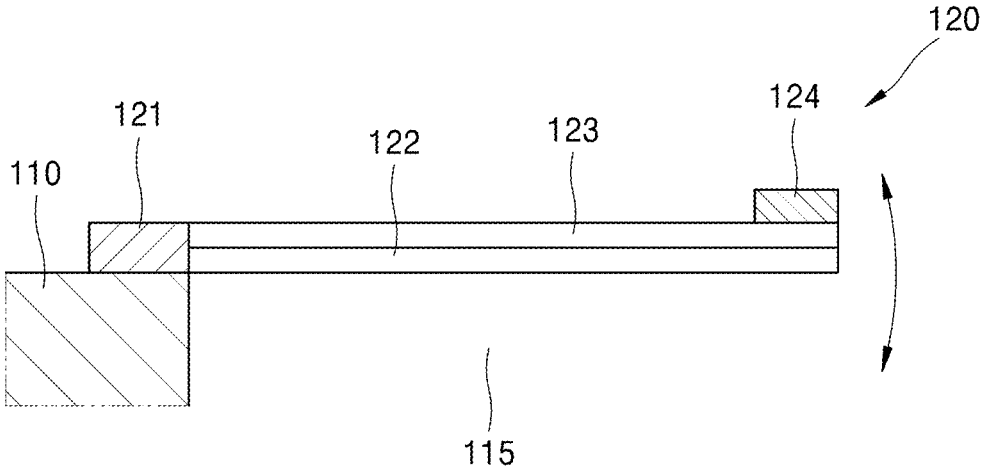
FIG. 3 is a cross-sectional view of one resonator of the example embodiment shown in FIG. 1.

FIG. 1 is a perspective view of a microphone 100 according to an example embodiment. FIG. 2 is a cross-sectional view taken along a line I-I' of FIG. 1. FIG. 3 is a cross-sectional view of one resonator 120 of the example embodiment shown in FIG. 1.

Referring to FIGS. 1 to 3, the microphone 100 may include a substrate 110, a resonator array, and a cover member 150. A cavity 115 is formed in the substrate 110 to penetrate therethrough. For example, a silicon substrate may be used as the substrate 110. However, this is merely exemplary, and the substrate 110 may include any of various other materials.

The resonator array may include a plurality of resonators 120 arranged in a certain form above the cavity 115 of the substrate 110. The resonators 120 may be arranged to be co-planar without overlapping. Each of the resonators 120 has a fixed portion 121, at one end thereof, fixed to the substrate 110 and may extend toward the cavity 115 from the one end portion. Each of the resonators 120 may include the fixed portion 121 fixed to the substrate 110, a movable portion 122 moveable in response to an acoustic signal, and a sensing portion 123 for sensing a movement of the movable portion 122. The sensing portion may include a sensor layer, such as a piezoelectric element for sensing the movement of the moveable portion. Furthermore, each of the resonators 120 may further include a mass 124 for providing a certain amount of weight to the movable portion 122.

The resonators 120 forming the resonator array may be configured to sense, for example, acoustic frequencies of different bands. In other words, the resonators 120 may have different center frequencies. To this end, the resonators 120 may have different dimensions. For example, the resonators 120 may have different lengths, widths, or thicknesses. The number of the resonators 120 provided above the cavity 115 may be variously changed according to design conditions.

FIG. 1 illustrates a case in which the resonators 120 having different lengths are arranged parallel to one another and in two rows along both side edges of the cavity 115. However, this is merely exemplary, and alternately the resonators 120 may be arranged in any of various forms. For example, the resonators 120 may be arranged in only a single row. Furthermore, the cavity 115 may be formed in a circular shape in the substrate 110, and the resonators 120 may be arranged in a circular form along the circumference of the cavity 115. The resonator array having the resonators 120 as described above may partially cover the cavity 115 formed in the substrate 110.

With respect to the cavity 115 formed in the substrate 110, an open portion thereof, remaining otherwise uncovered by the resonator array, may be filled with a filling member. In the present example embodiment, the filling member may include the cover member 150 that is provided to cover at least a part of the open portion of the cavity 115 that is left uncovered by the resonator array. The cover member 150 may increase a pressure gradient between an upper portion and a lower portion of the resonator array by increasing acoustic resistance. As such, as the pressure gradient between the upper portion and the lower portion of the resonator array increases, displacements of the resonators 120 forming the resonator array increase, and thus the sensitivity of the microphone 100 may be increased.

The cover member 150 may be provided in the form of a thin film. For example, the cover member 150 may be provided in the form of a thin film having a thickness similar to that of the resonators 120. In this case, although the cover member 150 may include the same material as the resonators 120, the present disclosure is not limited thereto. The cover member 150 may be provided to substantially cover an entirety of the open portion of the cavity 114, otherwise uncovered by the resonator array, to increase the pressure gradient between the upper portion and the lower portion of the resonator array.

Figure 4:
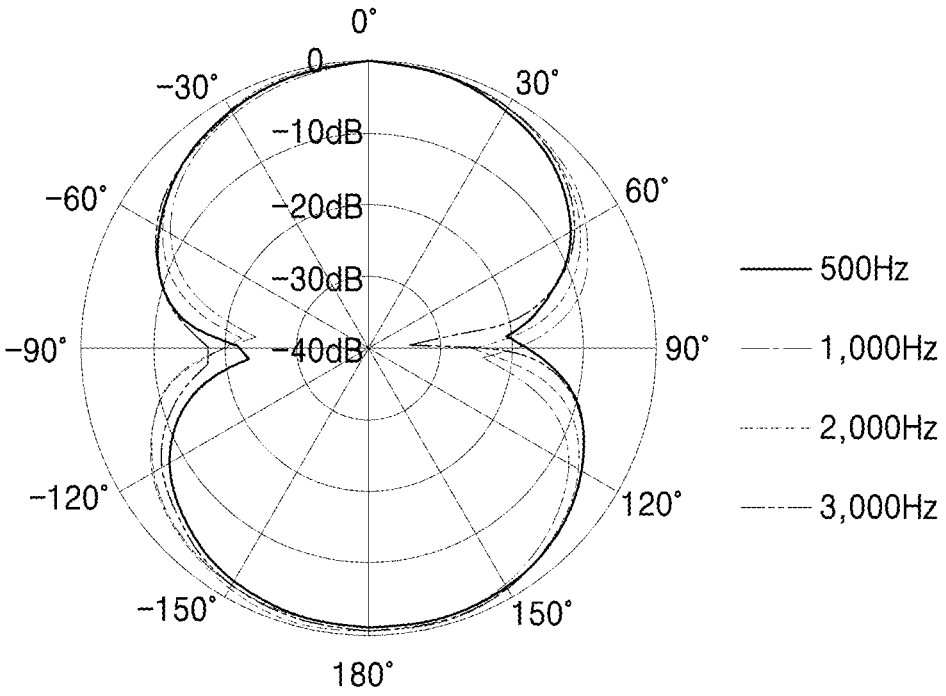
FIG. 4 illustrates measurement results with regard to directional characteristics of the microphone of FIG. 1.

FIG. 4 illustrates a result of a measurement of directional characteristics of the microphone 100 of FIG. 1. As illustrated in FIG. 4, it may be seen that the microphone 100 has bi-directionality, that is, a directionality in a +z axis direction, shown as the 0° direction in FIG. 4, and a directionality in a −z axis direction, shown as the 180° direction in FIG. 4. As such, the microphone 100 according to the present example embodiment may have directionality. Other microphones according to below-described example embodiments may have directionality like the microphone 100 of FIG. 1.

According to the microphone 100 according to the present example embodiment, since the cover member 150 is provided to cover the open portion in the cavity 115 remaining otherwise uncovered, the pressure gradient between the upper portion and the lower portion of the resonator array may be increased, and thus the sensitivity of the microphone 100 may be increased.

Although, in the above description, the resonator array is described as including the resonators 120 having different center frequencies, this is merely exemplary. For example, at least some of the resonators forming the resonator array may be configured to have the same center frequency or the resonator array may be configured to have only a single resonator.

Figure 5:
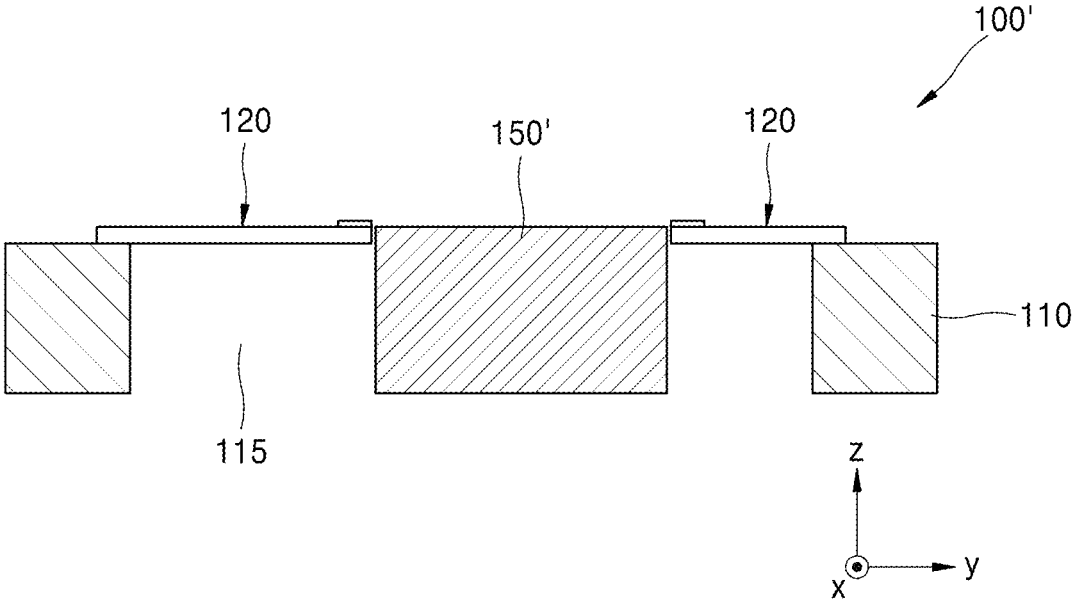
FIG. 5 is a cross-sectional view of a microphone according to another example embodiment.

FIG. 5 is a cross-sectional view of a microphone 100' according to another example embodiment. The microphone 100' shown in FIG. 5 is the same as the microphone 100 of FIG. 1, except that the cover member 150' is comparatively thick. Referring to FIG. 5, for example, the cover member 150' may be provided to have a thickness similar to that of the substrate 110. In addition, the cover member 150' may have any of various other thicknesses.

Figure 6A:
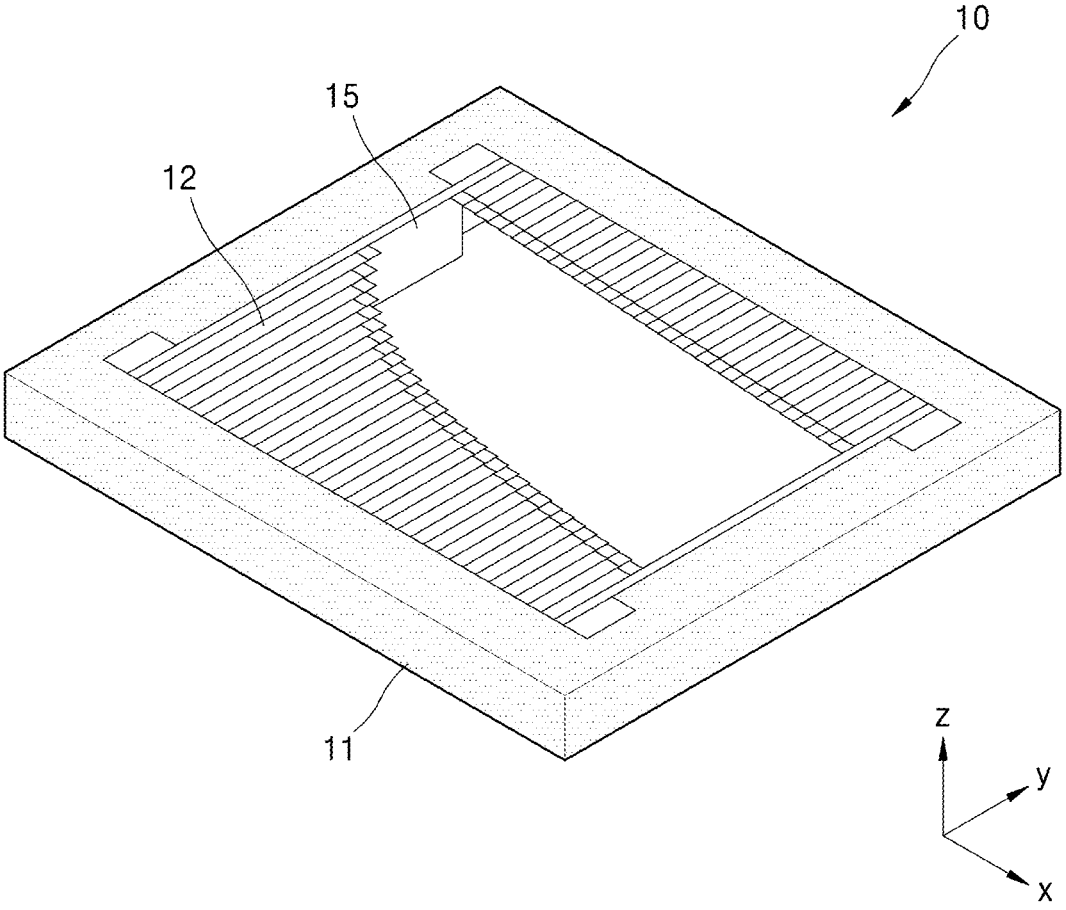
FIG. 6A is a perspective view of an example model of an existing microphone.
Figure 6B:
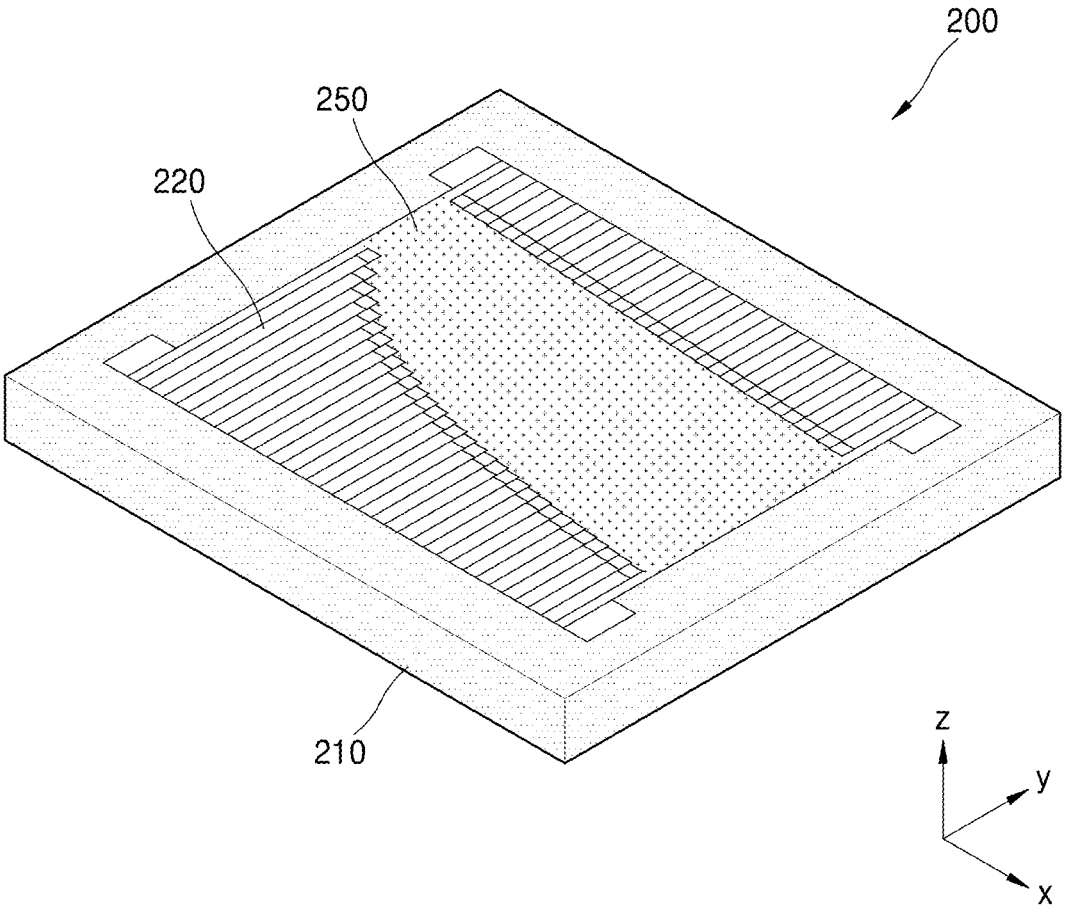
FIG. 6B is a perspective view of an example model of a microphone according to the example embodiment of FIG. 1.

FIG. 6A is a perspective view of an example model of an existing microphone 10. FIG. 6B is a perspective view of an example model of a microphone 200 according to the example embodiment of FIG. 1.

Referring to FIG. 6A, a cavity 15 is formed in a substrate 11, and penetrates therethrough. Sixty-four (64) resonators 12 having different lengths are arranged in the cavity 15, parallel to each other and in two rows, one at each side edge of the cavity 15, forming a resonator array. Accordingly, the resonator array covers a part of the cavity 15, and the other part of the cavity 15 is open.

Referring to FIG. 6B, a cavity (not shown) is formed in a substrate 210, and penetrates therethrough. Sixty-four (64) resonators 220 having different lengths are arranged in the cavity, parallel to each other and in two rows, one at each side edge of the cavity, forming a resonator array. Accordingly, the resonator array covers a part of the cavity. A cover member 250 is provided to entirely cover the remaining portion of the cavity not otherwise covered by the resonator array.

Figure 7A:
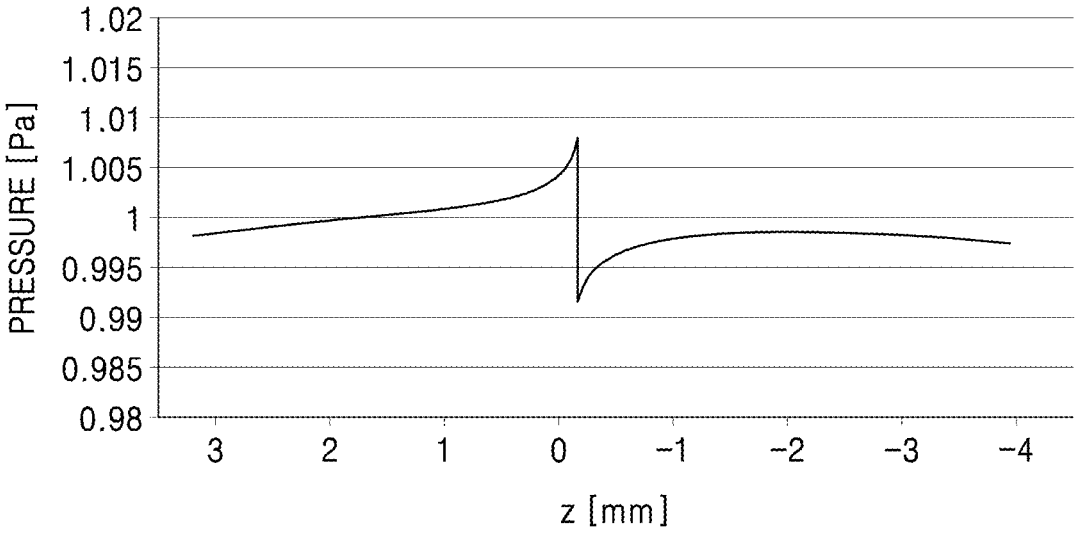
FIG. 7A is a graph showing simulated results with regard to pressure in an upper portion and a lower portion of a resonator array in the microphone shown in FIG. 6A.
Figure 7B:
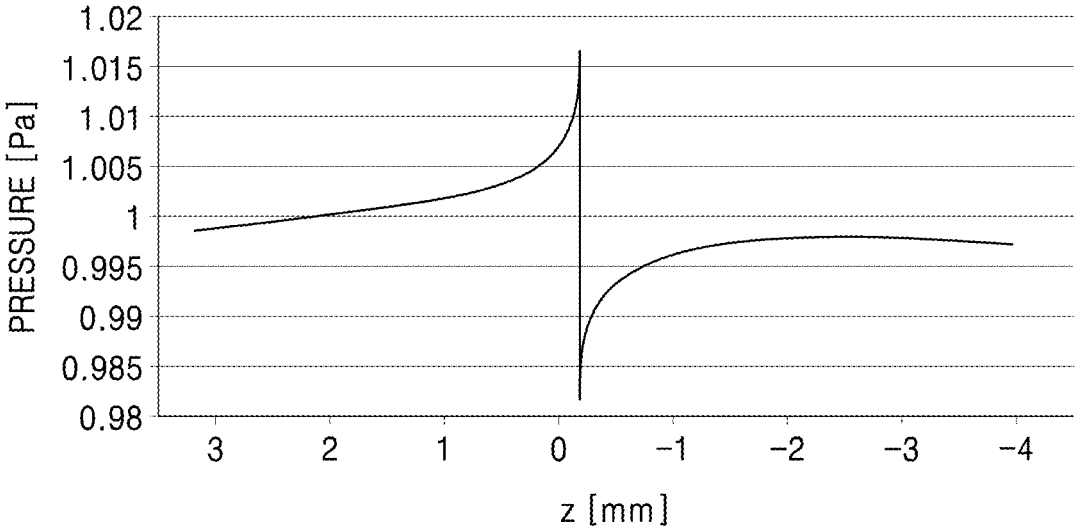
FIG. 7B is a graph showing simulated results with regard to pressure in an upper portion and a lower portion of a resonator array in the microphone shown in FIG. 6B.

FIG. 7A is a graph showing a simulated result of pressure in the upper portion and the lower portion of the resonator array in the microphone 10 shown in FIG. 6A. FIG. 7B is a graph showing a simulated result of pressure in the upper portion and the lower portion of the resonator array in the microphone 200 shown in FIG. 6B. FIGS. 7A and 7B respectively illustrate results of calculation when an acoustic frequency of 1 kHz is input to each of the microphone 10 shown in FIG. 6A and the microphone 200 shown in FIG. 6B. In FIGS. 7A and 7B, a positive (+) z value indicates a position above the resonator array, and a negative (−) z value indicates a position below the resonator array.

Referring to FIGS. 7A and 7B, a pressure gradient between the upper portion and the lower portion of the resonator array in the microphone 10 shown in FIG. 6A is 0.016 Pa, and a pressure gradient between the upper portion and the lower portion of the resonator array in the microphone 200 shown in FIG. 6B according to the present example embodiment is 0.036 Pa. It may be seen from the above results that the sensitivity of the microphone 200 shown in FIG. 6B is greater, by about 6.5 dB, than that of the microphone 10 shown in FIG. 6A.

Figure 8A:
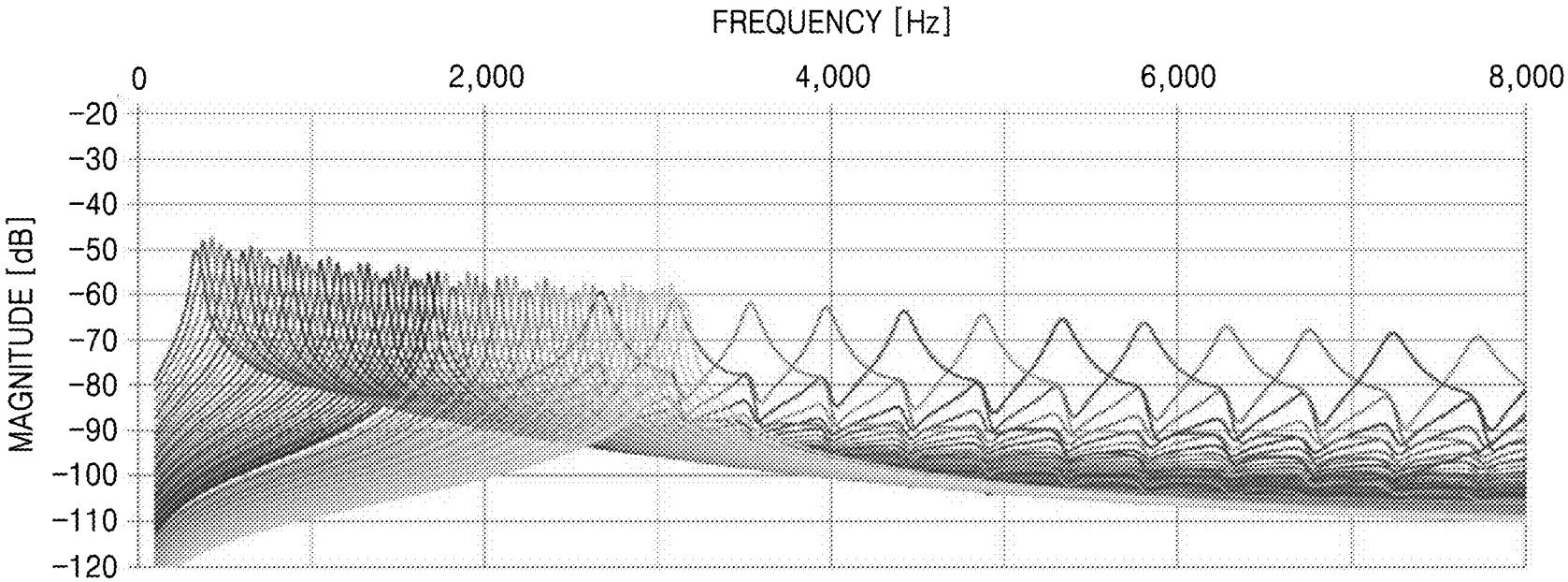
FIG. 8A is a graph showing simulated results with regard to frequency response characteristics of a resonator array in the microphone shown in FIG. 6A.
Figure 8B:
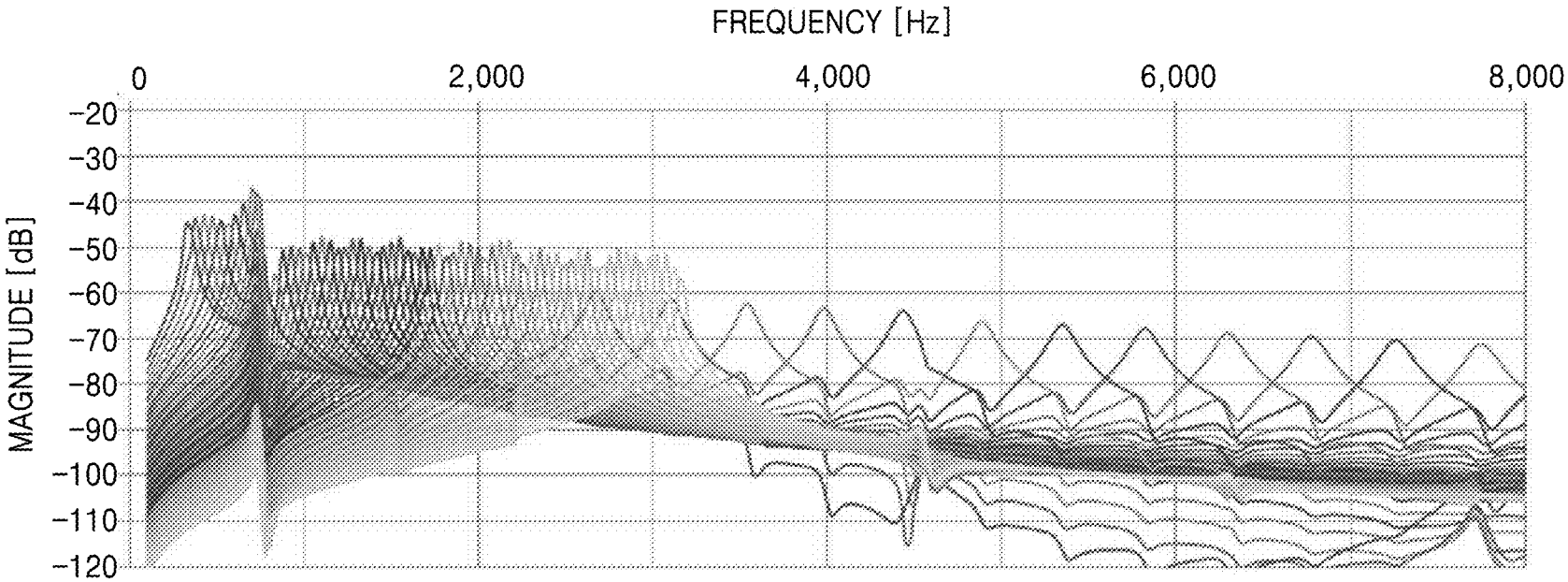
FIG. 8B is a graph showing simulated results with regard to frequency response characteristics of a resonator array in the microphone shown in FIG. 6B.

FIG. 8A is a graph showing a simulated result showing frequency response characteristics of the resonator array in the microphone 10 shown in FIG. 6A. FIG. 8B is a graph showing a simulated result showing frequency response characteristics of the resonator array in the microphone 200 shown in FIG. 6B.

Referring to FIGS. 8A and 8B, a displacement of the resonators 220 of the microphone 200 shown in FIG. 6B is greater, that that of the resonators 12 of the microphone 10 shown in FIG. 6A. It may be seen from the above results that the sensitivity of the microphone 200 shown in FIG. 6B is greater, by about 6.2 dB, than that of the microphone 10 shown in FIG. 6A.

Figure 9A:
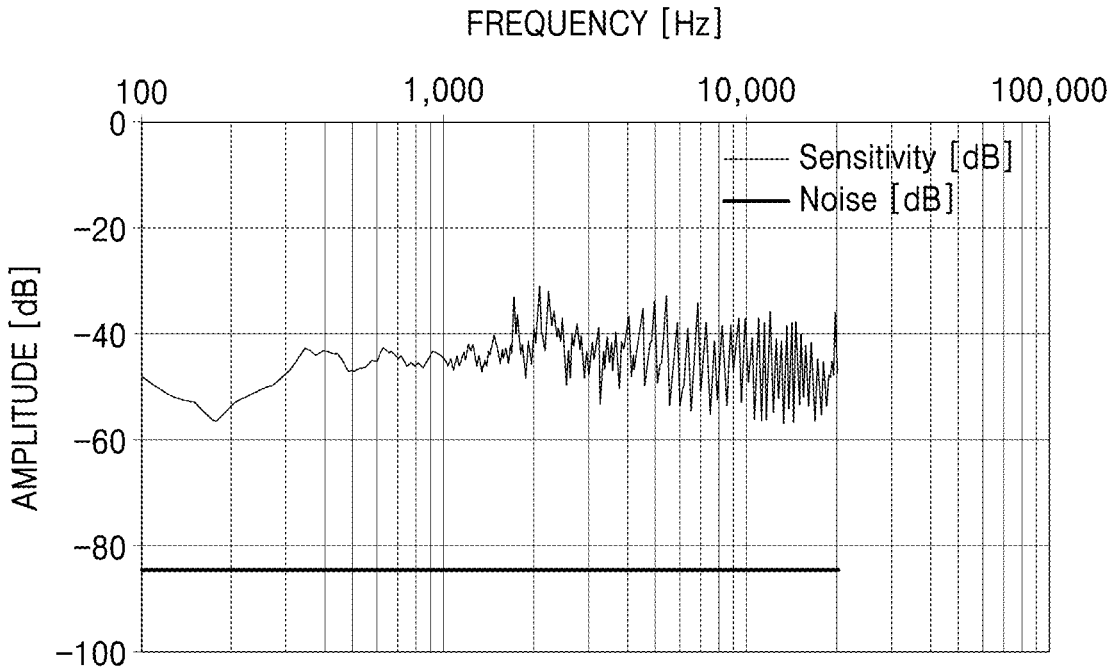
FIG. 9A is a graph showing a result of measuring a sensitivity of the microphone shown in FIG. 6A.
Figure 9B:
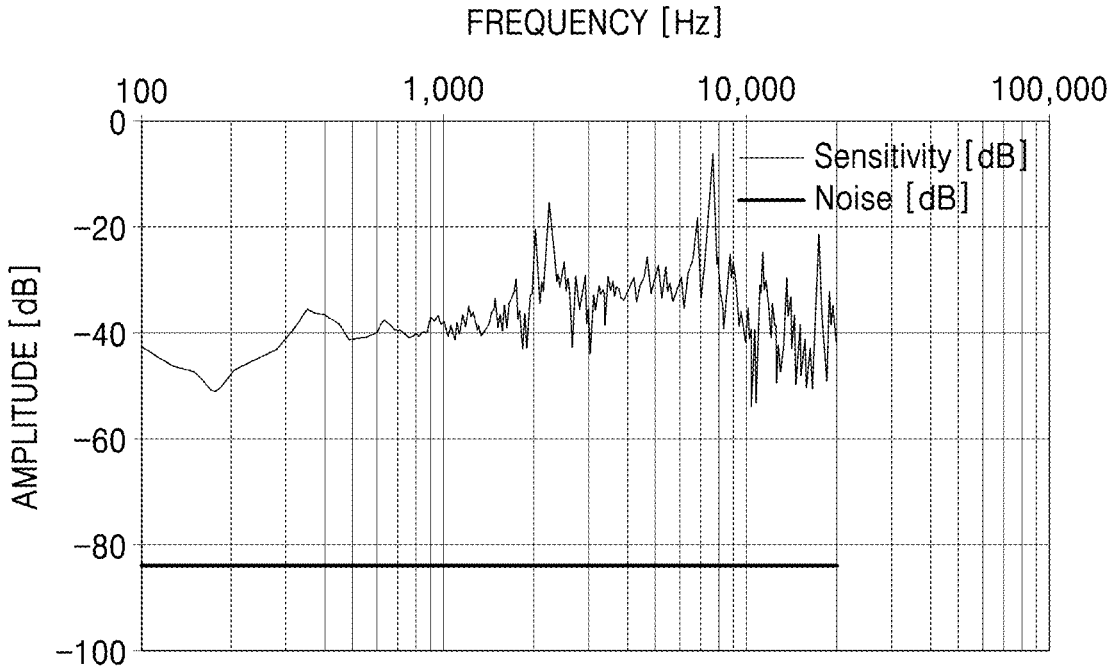
FIG. 9B is a graph showing measurement results with regard to a sensitivity of the microphone shown in FIG. 6B.

FIG. 9A is a graph showing a result of measuring the sensitivity of the microphone 10 shown in FIG. 6A. FIG. 9B is a graph showing a result of measuring the sensitivity of the microphone 200 shown in FIG. 6B.

It may be seen from the results of actual measurements as illustrated in FIGS. 9A and 9B that the sensitivity of the microphone 200 shown in FIG. 6B is greater than that of the microphone 10 shown in FIG. 6A.

Figure 9C:
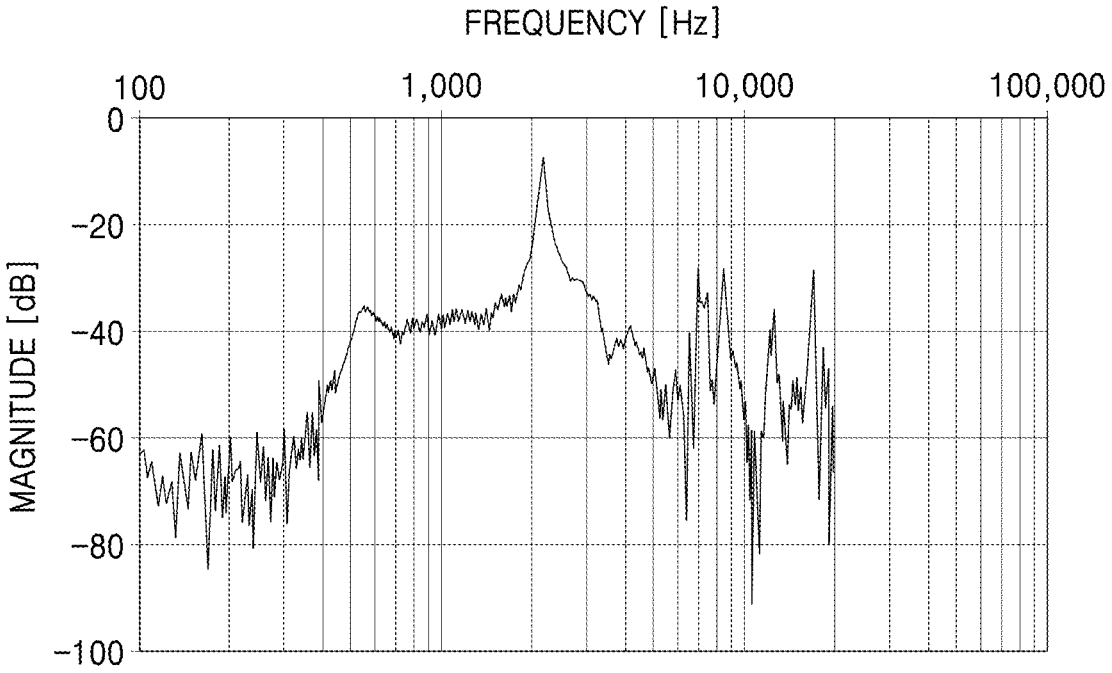
FIG. 9C is a graph showing measurement results with regard to frequency response characteristics of a cover member of the microphone shown in FIG. 6B.

FIG. 9C is a graph showing a result of measuring frequency response characteristics of the cover member 250 in only the microphone 200 shown in FIG. 6B. As illustrated in FIG. 9C, it may be seen that a displacement is generated in the cover member 250 when an acoustic signal is input to the microphone 200 shown in FIG. 6B. As the displacement of the cover member 250 generated as above affects the displacement of the resonators 220 forming the resonator array, the sensitivity of the microphone 200 shown in FIG. 6B may be further increased.

Figure 10:
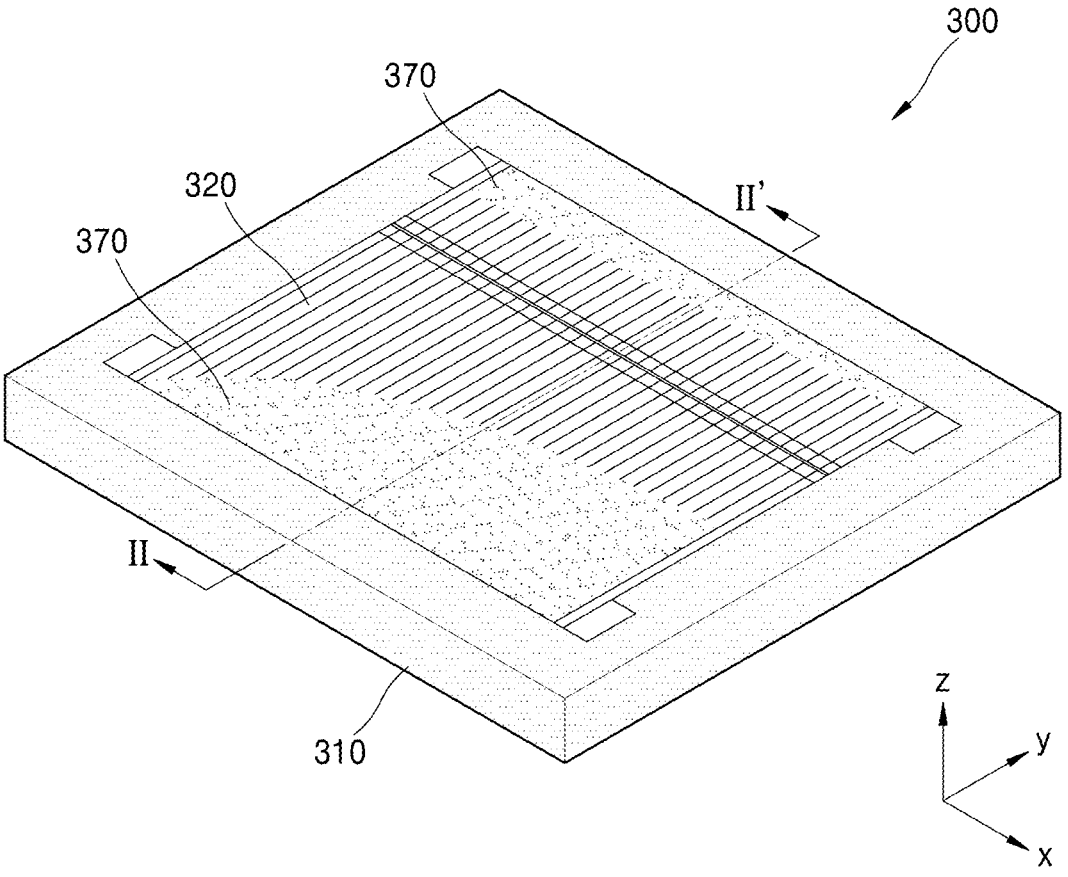
FIG. 10 is a perspective view of a microphone according to another example embodiment.
Figure 11:
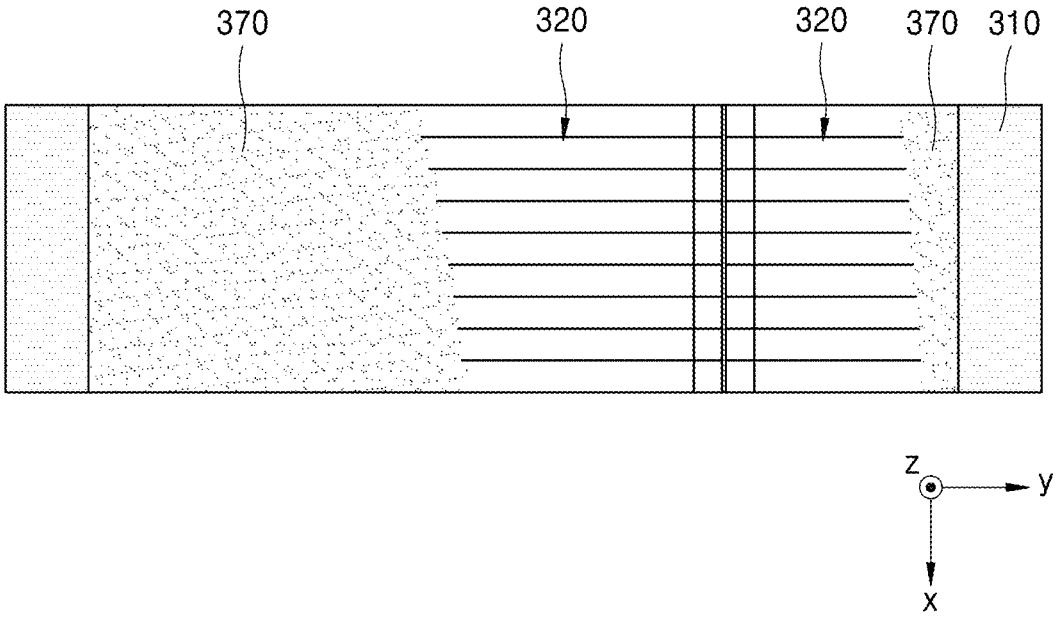
FIG. 11 is a plan view of an enlarged part of the microphone shown in FIG. 10.
Figure 12:
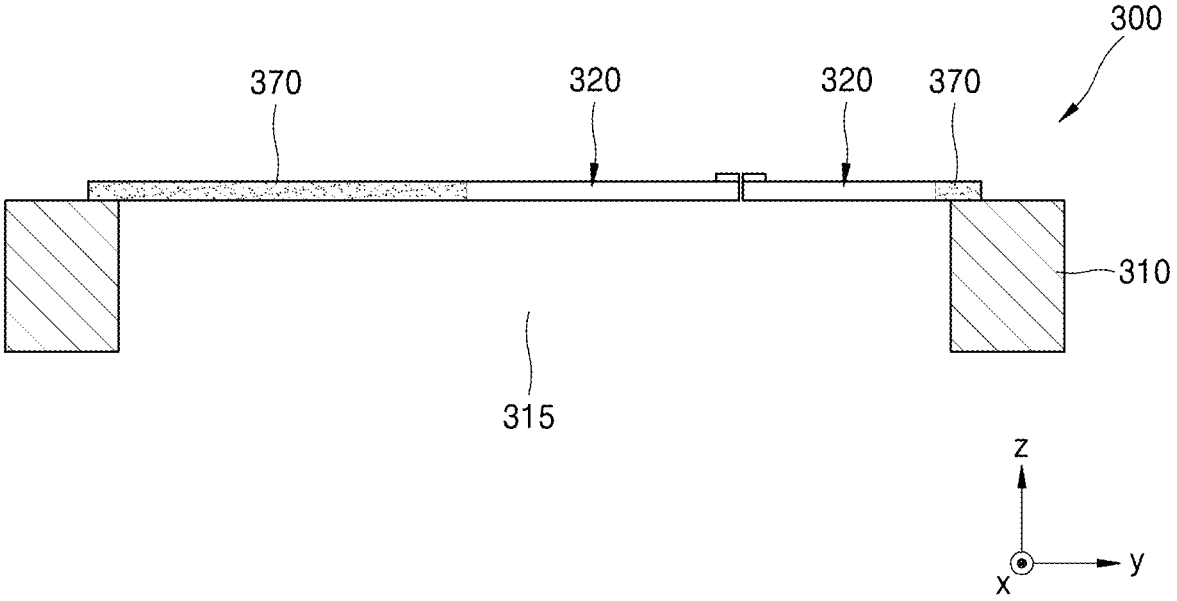
FIG. 12 is a cross-sectional view taken along a line II-II' of FIG. 10.

FIG. 10 is a perspective view of a microphone 300 according to another example embodiment. FIG. 11 is a plan view of an enlarged part of the microphone 300 shown in FIG. 10. FIG. 12 is a cross-sectional view taken along a line II-II' of FIG. 10.

Referring to FIGS. 10 to 12, the microphone 300 may include a substrate 310, a resonator array, and a fixing member 370. A cavity 315 is formed in the substrate 310 and penetrates therethrough. For example, a silicon substrate may be used as the substrate 310. However, this is merely exemplary, and the substrate 310 may include any of various other materials.

The resonator array may include a plurality of resonators 320 arranged in a certain form above the cavity 315 of the substrate 310. The resonators 320 may have, for example, different lengths, and different center frequencies. FIG. 10 illustrates that the resonators 320 having different lengths arranged in parallel and in two rows along two sides of a center portion of the cavity 315. However, this is merely exemplary, and the resonators 320 may be arranged in any of various other forms. The resonator array may partially cover the cavity 315 formed in the substrate 310.

The fixing member 370 for fixing one end portion of each of the resonators 320 is provided between the substrate 310 and the resonator array. One side of the fixing member 370 is fixed to the substrate 310, and the one end portion of each of the resonators 320 is fixed to the other side of the fixing member 370. Furthermore, the fixing member 370 may be provided to cover a portion of the cavity 315 otherwise uncovered by the resonators 320. The fixing member 370 may cover at least part of the open portion of the cavity 315 not otherwise covered by the resonator array. As such, the fixing member 370 may serve as a filling member for filling the otherwise open portion of the cavity 315. FIG. 10 illustrates a case in which the resonators 320 are arranged in two rows at a center portion of the cavity 315, and the fixing member 370 is provided at each of both sides of the cavity 315.

The fixing member 370 may increase displacements of the resonators 320 by a coupling effect as described below, and increase the pressure gradient between the upper portion and the lower portion of the resonator array by covering the otherwise open portion of the cavity 315, thereby increasing the sensitivity of the microphone 300.

The fixing member 370 may move in association with movements of resonators 320, and may cover at least part of the cavity 315. The fixing member 370 may be provided in the form of a thin film. For example, the fixing member 370 may be provided in the form of a thin film having a thickness similar to that of the resonators 320. Although the fixing member 370 may include the same material as the resonators 320, the present disclosure is not limited thereto.

When the fixing member 370 moves in association with movement of the resonators 320, the displacements of the resonators 320 forming the resonator array may be increased by the coupling effect. Accordingly, the sensitivity of the microphone 300 may be increased. In detail, when a specific one of the resonators 320 of the resonator array moves, the fixing member 370 moves in association with the movement of the specific one of the resonators 320. Also, as the movement of the fixing member 370 affects the movements of the resonators 320 adjacent to the specific one of the resonators 320, the displacements of the resonators 320 may be increased, and thus the sensitivity of the microphone 300 may be increased.

Furthermore, as the fixing member 370 covers the otherwise open portion of the cavity 315, the pressure gradient between the upper portion and the lower portion of the resonator array is increased, and thus the sensitivity of the microphone 300 may be further increased. In detail, the fixing member 370 covers at least part of the otherwise open portion of the cavity 315. Accordingly, since the pressure gradient between the upper portion and the lower portion of the resonator array may be increased, the sensitivity of the microphone 300 may be increased. The fixing member 370 may entirely cover the otherwise open portion of the cavity 315, in order to increase the pressure gradient between the upper portion and the lower portion of the resonator array.

With respect to the microphone 300 according to the present example embodiment, as the fixing member 370 that fixes the one end portion of each of the resonators 320 is configured to move in association with the resonators 320, the displacements of the resonators 320 may be increased by the coupling effect. Accordingly, the sensitivity of the microphone 300 may be increased. Furthermore, as the fixing member 370 covers the otherwise open portion of the cavity 315 formed in the substrate 310, the pressure gradient between the upper portion and the lower portion of the resonator array may be increased. Accordingly, the sensitivity of the microphone 300 may be further increased.

Figure 13A:
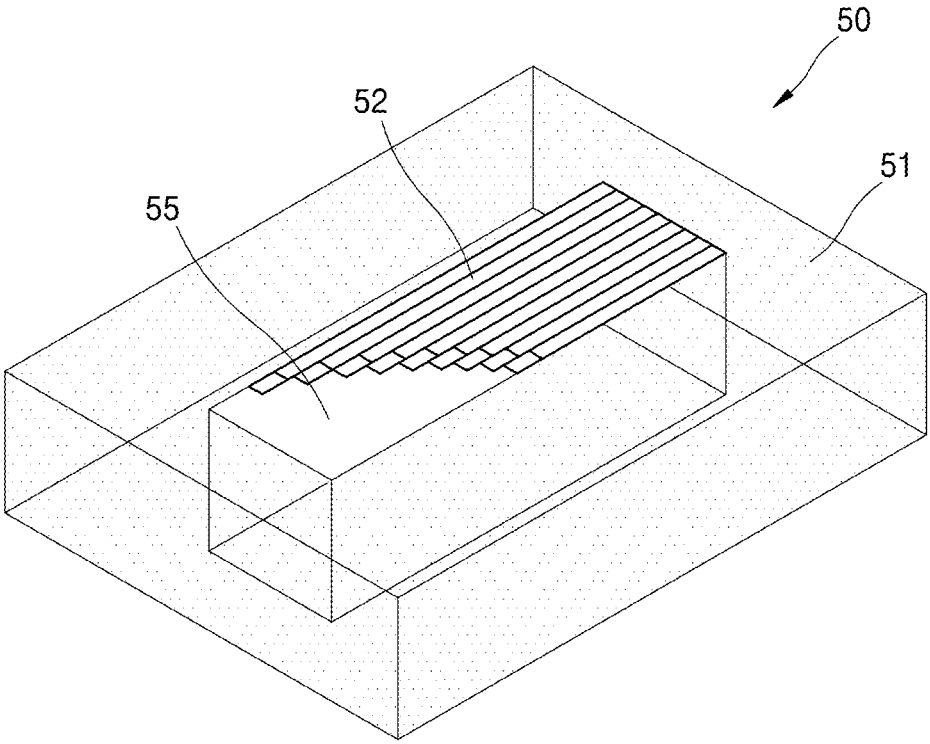
FIG. 13A is a perspective view of an example model of an existing microphone.
Figure 13B:
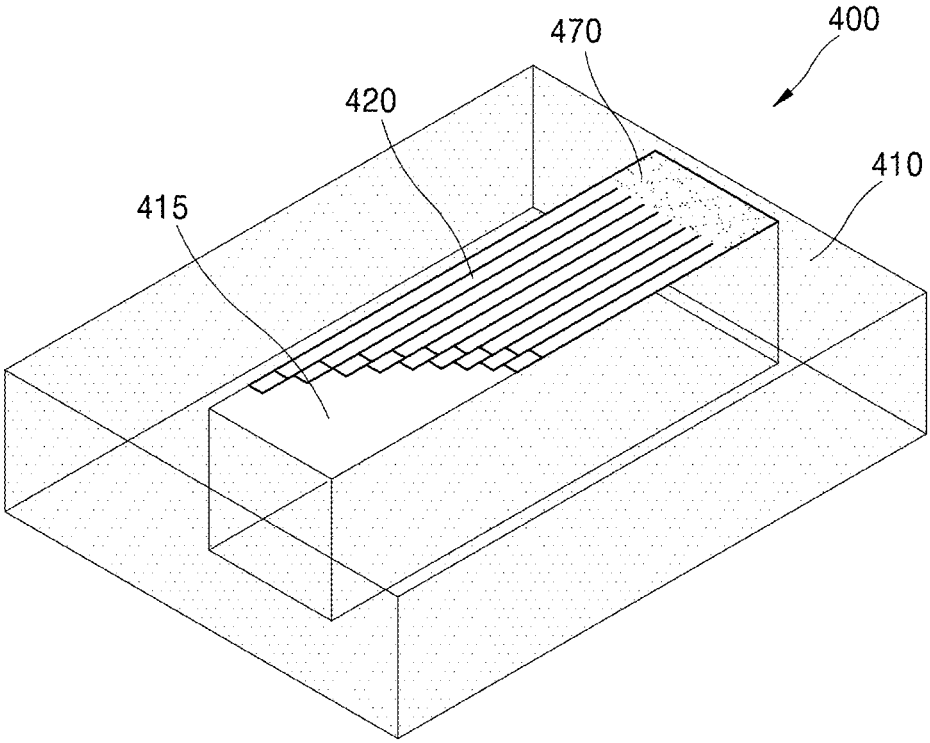
FIG. 13B is a perspective view of an example model of the microphone according to the example embodiment shown in FIG. 10.

FIG. 13A is a perspective view of an example model of an existing microphone 50. FIG. 13B is a perspective view of an example model of a microphone 400 according to the example embodiment shown in FIG. 10.

Referring to FIG. 13A, a cavity 55 is formed in a substrate 51 and penetrates therethrough. Nine (9) resonators 52 having different lengths are arranged in one row at one side of the cavity 55, forming a resonator array. The resonator array covers a part of the cavity 55, and the other part of the cavity 55 is open.

Referring to FIG. 13B, a cavity 415 is formed in a substrate 410 and penetrates therethrough. Nine (9) resonators 420 having different lengths are arranged in one row at one side of the cavity 415, forming a resonator array. A fixing member 470 is provided between the substrate 410 and the resonator array and fixes one end portion of each of the resonators 420 and covers a part of the cavity 415.

Figure 14A:
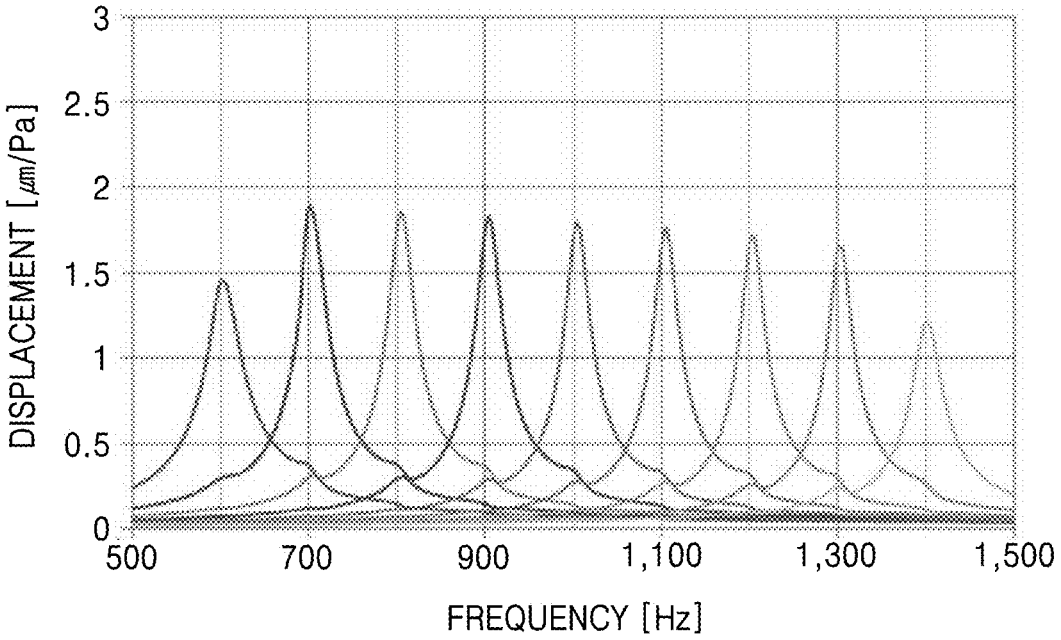
FIG. 14A is a graph showing simulated results regarding displacements of the resonators in the microphone shown in FIG. 13A.
Figure 14B:
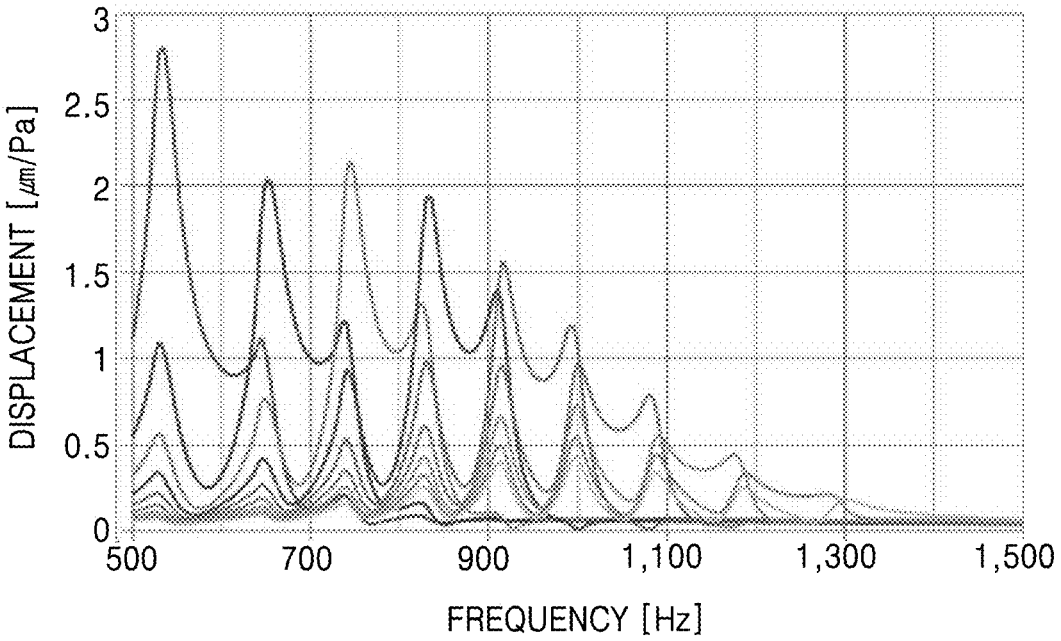
FIG. 14B is a graph showing simulated results regarding displacements of the resonators in the microphone shown in FIG. 13B.

FIG. 14A is a graph showing a simulated result of displacements of the resonators in the microphone 50 shown in FIG. 13A. FIG. 14B is a graph showing a simulated result of displacements of the resonators in the microphone 400 shown in FIG. 13B.

Referring to FIGS. 14A and 14B, it may be seen that the displacements of the resonators 420 of the microphone 400 shown in FIG. 13B are greater than those of the resonators 52 of the microphone 50 shown in FIG. 13A. In detail, it may be seen that displacements of the resonators 420 adjacent to the specific one of the resonators 420 is increased by the coupling effect when a displacement is generated in a specific one of the resonators 420 as illustrated in FIG. 14B. Accordingly, the sensitivity of the microphone 400 shown in FIG. 13B may be greater as compared to the sensitivity of the microphone 50 of FIG. 13A.

Figure 15:
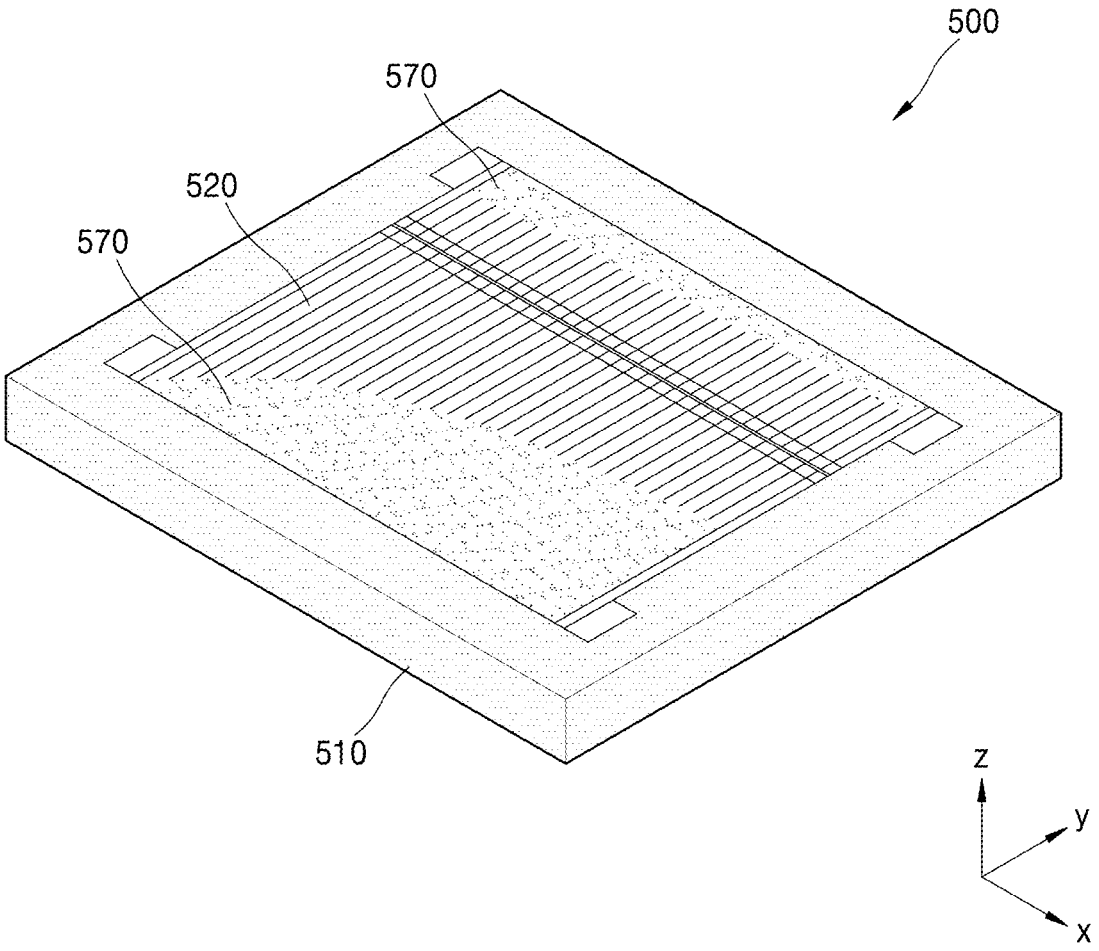
FIG. 15 is a perspective view of another example model of the microphone according to the example embodiment shown in FIG. 10.

FIG. 15 is a perspective view of another example model of a microphone 500 according to the example embodiment shown in FIG. 10.

Referring to FIG. 15, a cavity 515 is formed in a substrate 510 and penetrates therethrough. Sixty-four (64) resonators 520 having different lengths are arranged in two rows along a center portion of the cavity 515, forming a resonator array. A fixing member 570 fixes one end portion of each of the resonators 520 and is provided between the substrate 510 and a resonator array at both sides of the cavity 515. Together, the resonator array and the fixing member 570 entirely cover the cavity 515. In detail, the resonator array covers the center portion of the cavity 515, and the fixing member 570 covers both side portions of the cavity 515.

Figure 16A:
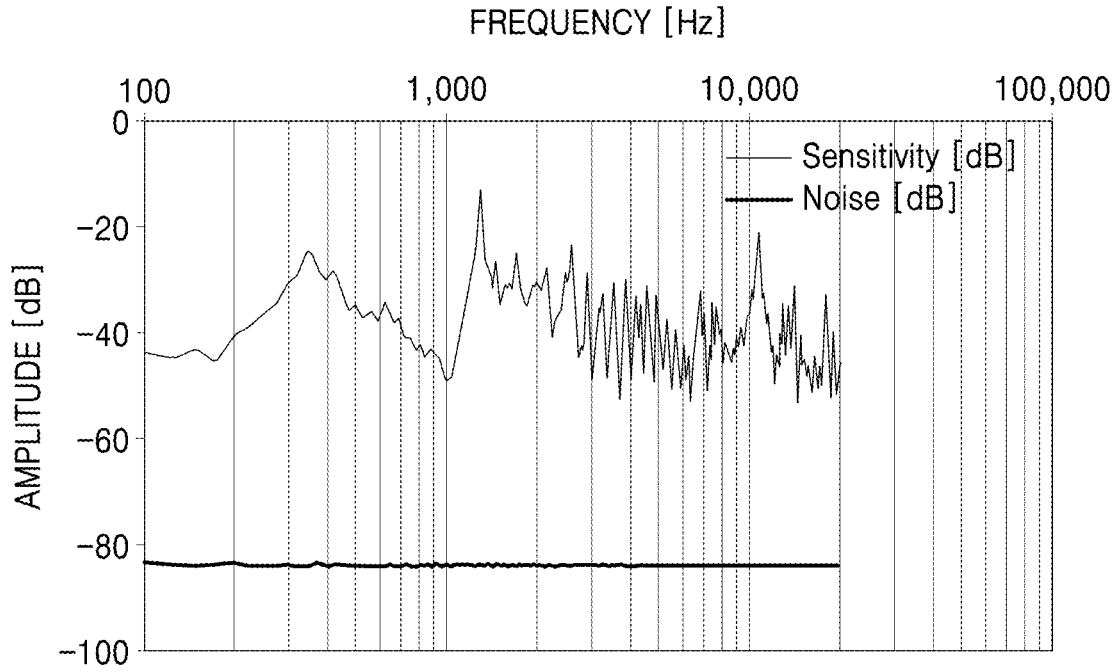
FIG. 16A is a graph showing measurement results with regard to a sensitivity of the microphone shown in FIG. 15.

FIG. 16A is a graph showing a result of measuring sensitivity of the microphone 500 shown in FIG. 15.

As described above, FIG. 9A illustrates a result of the measurement of the sensitivity of the microphone 10 shown in FIG. 6A. When the measurement results shown in FIGS. 9A and 16A are compared with each other, it may be seen that the sensitivity of the microphone 500 according to the example embodiment shown in FIG. 15 is increased as compared to the sensitivity of the microphone 10 shown in FIG. 6A.

Figure 16B:
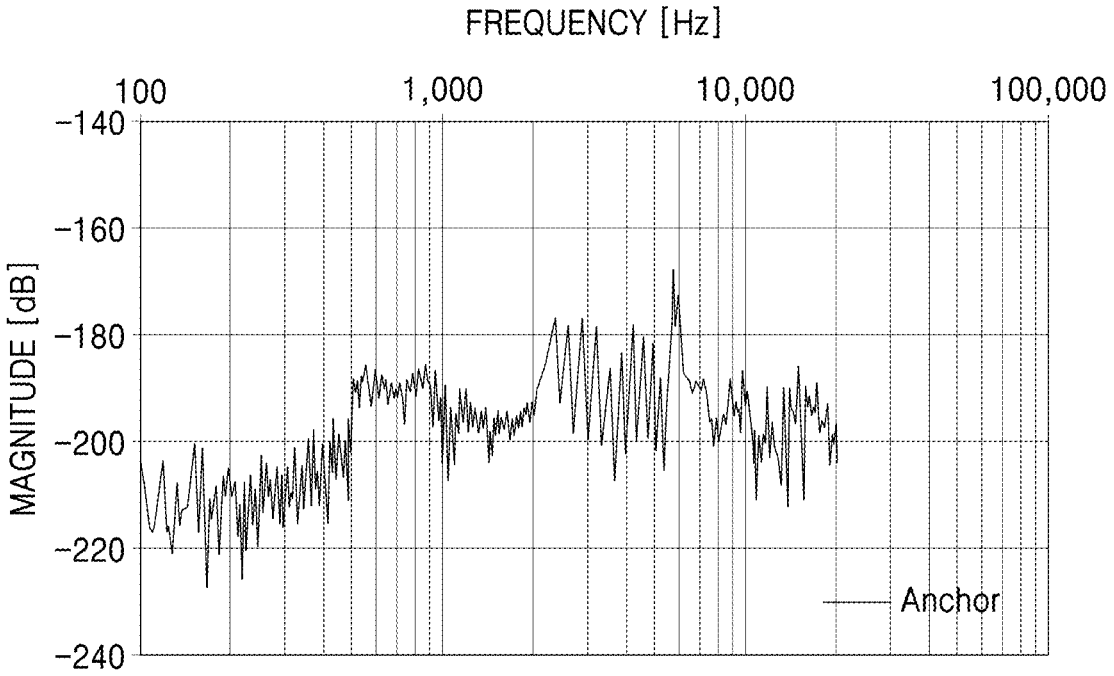
FIG. 16B is a graph showing measurement results with regard to frequency response characteristics of a fixing member in the microphone shown in FIG. 15.

FIG. 16B is a graph showing a result of measuring frequency response characteristics of the fixing member 570 in only the microphone shown in FIG. 15. As illustrated in FIG. 16B, when an acoustic signal is input to the microphone 500 shown in FIG. 15, it may be seen that the fixing member 570, moving in association with movements of the resonators 520, generates a displacement. Since the movement of the fixing member 570 increases the displacements of the resonators 520, the sensitivity of the microphone 500 may be increased.

Figure 17:
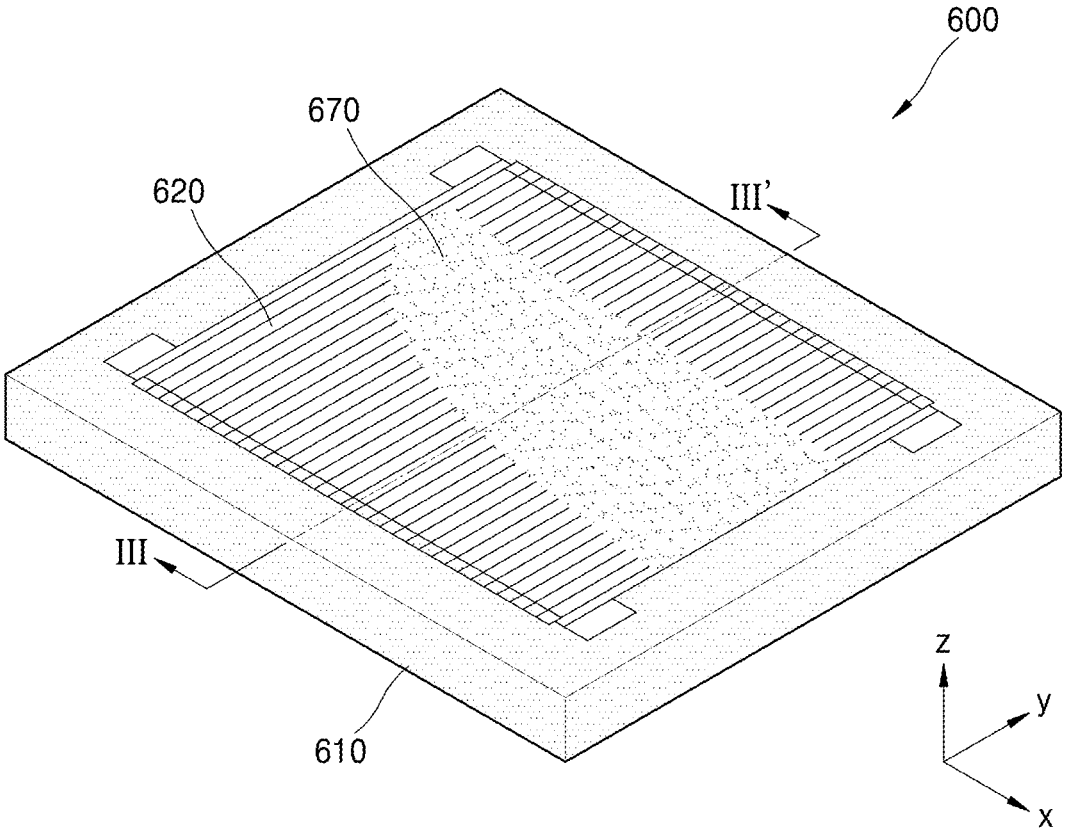
FIG. 17 is a perspective view of a microphone according to another example embodiment.
Figure 18:
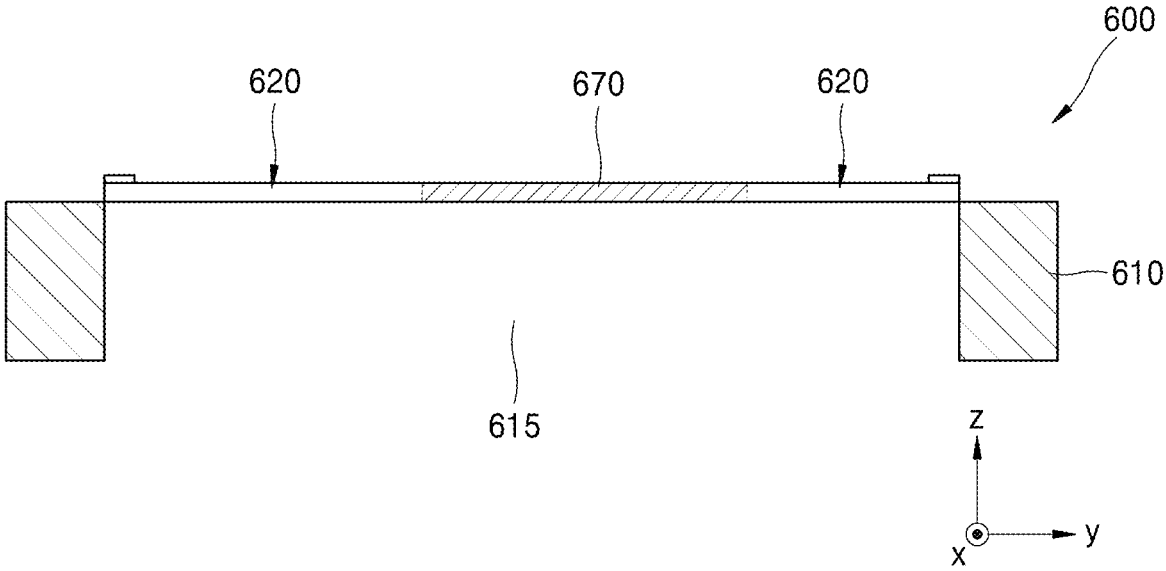
FIG. 18 is a cross-sectional view taken along a line III-III' of FIG. 17.

FIG. 17 is a perspective view of a microphone 600 according to another example embodiment. FIG. 18 is a cross-sectional view taken along a line III-III' of FIG. 17.

Referring to FIGS. 17 and 18, the microphone 600 may include a substrate 610, a resonator array, and a fixing member 670. A cavity 615 is formed in the substrate 610 and penetrates therethrough. The resonator array may include a plurality of resonators 620 arranged in a certain form above the cavity 615 of the substrate 610. FIG. 17 illustrates a case in which the resonators 620 having different lengths are arranged in two rows at both sides of the cavity 615. The resonator array may partially cover the cavity 615 formed in the substrate 610.

The fixing member 670 is provided at a center portion of the cavity 615 between the resonators 620 arranged at both sides of the cavity 615. Each of both sides of the fixing member 670 fixes one end portion of each of the resonators 620. The fixing member 670 may cover the center portion of the cavity 615.

The fixing member 670 may move in association with movements of the resonators 620, and may cover at least a part of the cavity 615. The fixing member 670 may be provided in the form of a thin film. The fixing member 670 may entirely cover the open portion in the cavity 615, otherwise uncovered by the resonator array, in order to increase the pressure gradient between the upper portion and the lower portion of the resonator array.

With respect to the microphone 600 according to the present example embodiment, as the fixing member 670 fixes one end portion of each of the resonators 620 and moves in association with the resonators 620, the displacements of the resonators 620 may be increased by the coupling effect. Accordingly, the sensitivity of the microphone 600 may be increased. Furthermore, as the fixing member 670 covers an otherwise open portion of the cavity 615 not covered by the resonators 620, the pressure gradient between the upper portion and the lower portion of the resonator array may be increased. Accordingly, the sensitivity of the microphone 600 may be increased.

Figure 19:
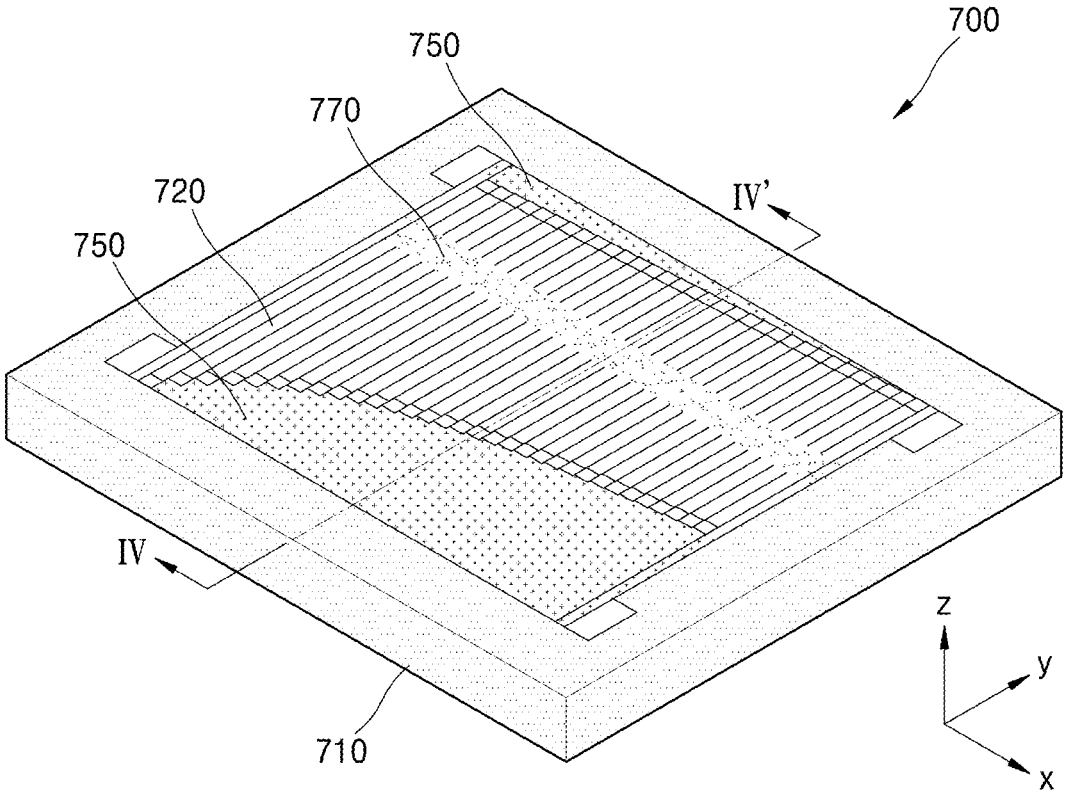
FIG. 19 is a perspective view of a microphone according to another example embodiment.
Figure 20:
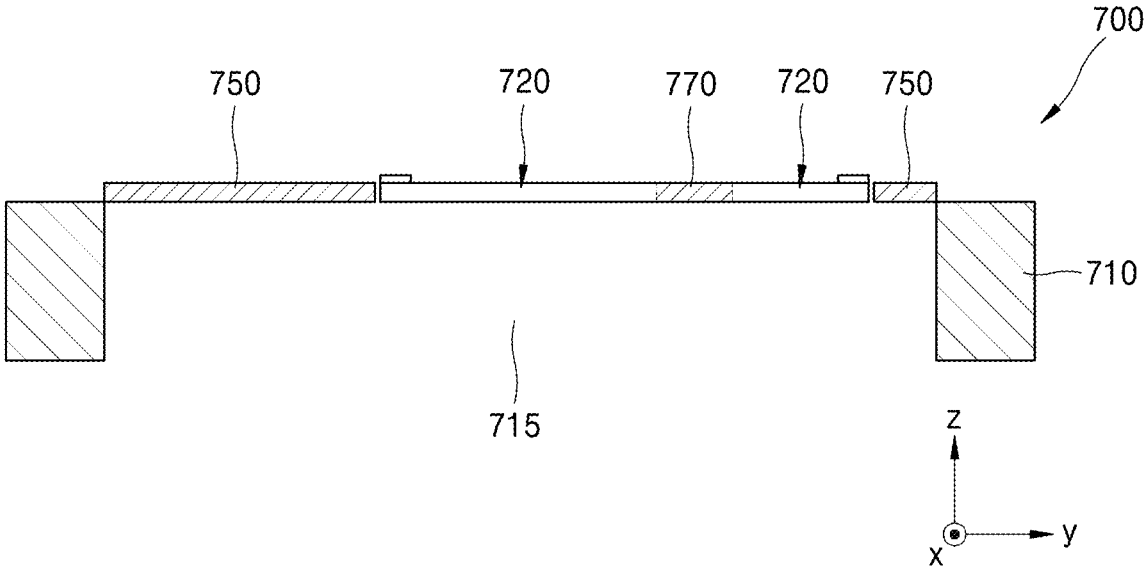
FIG. 20 is a cross-sectional view taken along a line IV-IV' of FIG. 17.

FIG. 19 is a perspective view of a microphone 700 according to another example embodiment. FIG. 20 is a cross-sectional view taken along a line IV-IV' of FIG. 17.

Referring to FIGS. 19 and 20, the microphone 700 may include a substrate 710, a resonator array, and a filling member. A cavity 715 is formed in the substrate 710 and penetrates therethrough. The resonator array may include a plurality of resonators 720 arranged in a certain form above the cavity 715 of the substrate 710. FIG. 19 illustrates a case in which the resonators 720 having different lengths are arranged in two rows at a center portion of the cavity 715.

The filling member may be provided to fill an open portion of the cavity 715, otherwise uncovered by the resonator array in. The filling member may include a cover member 750 and a fixing member 770. In FIG. 19, the fixing member 770 may cover the portion of the cavity 715 disposed between the resonators 720 arranged in two rows, and the cover member 750 may cover the cavity 715 disposed at both sides of the resonators 720.

Each of both sides of the fixing member 770 is provided to fix one end portion of each of the resonators 720. The fixing member 770 may be provided in the form of a thin film to be capable of moving in association with the movements of the resonators 720. The cover member 750 may cover the open portion of the cavity 715 not otherwise covered by the resonator array or the fixing member 770. Together, fixing member 770 and the cover member 750 may entirely cover the otherwise open portion of the cavity 175 not covered by the resonator array, in order to increase the pressure gradient between the upper portion and the lower portion of the resonator array.

With respect to the microphone 700 according to the present example embodiment, since the cover member 750 covers a part of the otherwise open portion of the cavity 715 not covered by the resonator array, the pressure gradient between the upper portion and the lower portion of the resonator array may be increased. Accordingly, the sensitivity of the microphone 700 may be increased. Furthermore, since the fixing member 770 fixes the one end portion of each of the resonators 720 and covers the otherwise open portion of the cavity 715 not covered by the resonator array or the cover member 750, the displacements of the resonators 720 may be increased and simultaneously the pressure gradient between the upper portion and the lower portion of the resonator array may be increased. Accordingly, the sensitivity of the microphone 700 may be increased.

Figure 21:
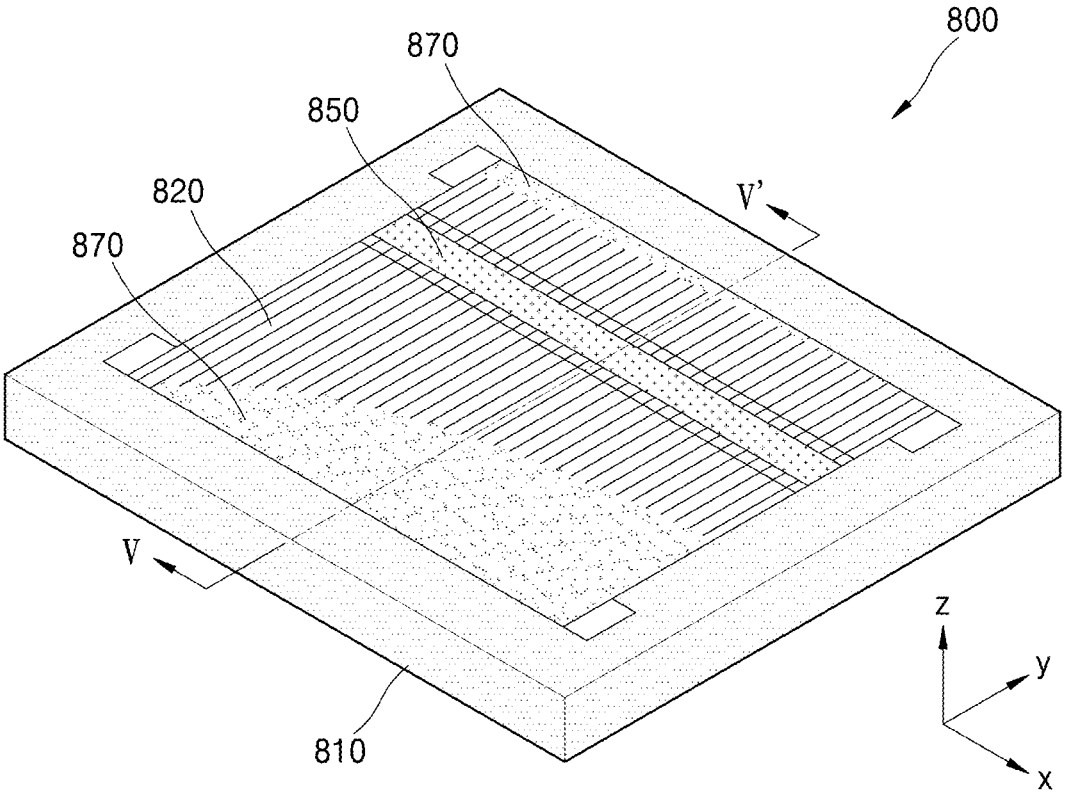
FIG. 21 is a perspective view of a microphone according to another example embodiment.
Figure 22:
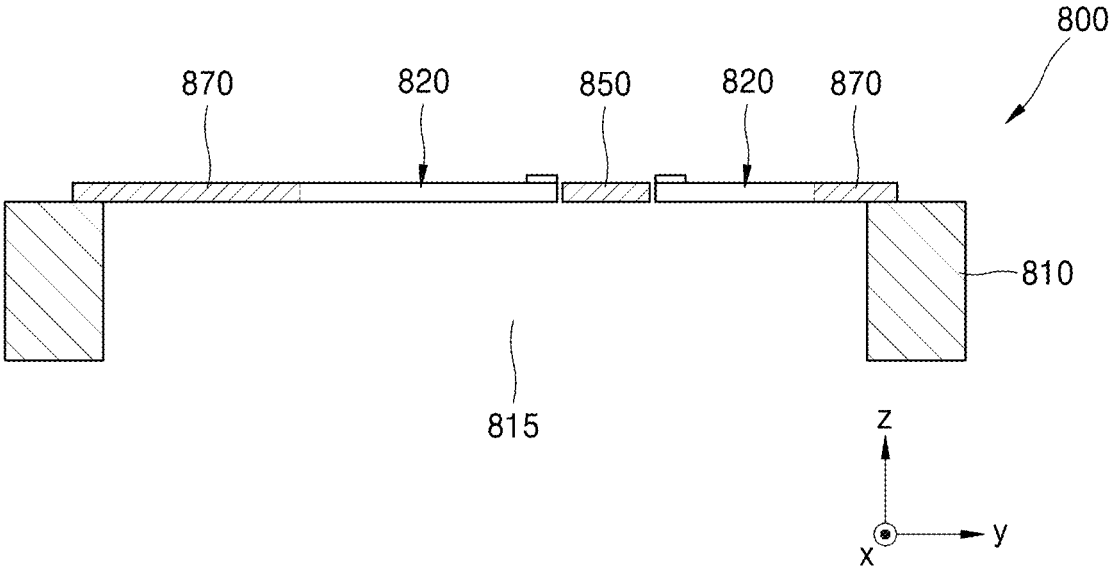
FIG. 22 is a cross-sectional view taken along a line V-V' of FIG. 21.

FIG. 21 is a perspective view of a microphone 800 according to another example embodiment. FIG. 22 is a cross-sectional view taken along a line V-V' of FIG. 21.

Referring to FIGS. 21 and 22, the microphone 800 may include a substrate 810, a resonator array, and a filling member. A cavity 815 is formed in the substrate 810 and penetrates therethrough. The resonator array may include a plurality of resonators 820 arranged in a certain form above the cavity 815 of the substrate 810. FIG. 21 illustrates a case in which the resonators 820 having different lengths are arranged in two rows at a center portion of the cavity 815.

The filling member may fill the otherwise open portion of the cavity 815 not covered by the resonator array. The filling member may include a cover member 850 and a fixing member 870. In FIG. 21, the cover member 850 may cover the portion of the cavity 815 disposed between the resonators 820 arranged in two rows, and the fixing member 870 may cover the portion of the cavity 815 disposed at both sides of the resonators 820.

One side of the fixing member 870 fixes one end portion of each of the resonators 820 and the other side of the fixing member 870 is fixed to the substrate 810. The fixing member 870 may be provided in the form of a thin film to be capable of moving in association with the movements of the resonators 820. The cover member 850 may cover an otherwise open portion of the cavity 815 not covered by the resonator array or the fixing member 870. Together, the fixing member 870 and the cover member 850 may entirely cover the otherwise open portion of the cavity 815 to increase the pressure gradient between the upper portion and the lower portion of the resonator array.

With respect to the microphone 800 according to the present example embodiment, since the cover member 850 covers a part of the otherwise open portion of the cavity 815 not covered by the resonator array, the pressure gradient between the upper portion and the lower portion of the resonator array may be increased. Accordingly, the sensitivity of the microphone 800 may be increased. Furthermore, since the fixing member 870 fixes the one end portion of each of the resonators 820 and cover the otherwise open portion of the cavity 815 not covered by the resonator array or the cover member 850, the displacements of the resonators 820 may be increased and simultaneously the pressure gradient between the upper portion and the lower portion of the resonator array may be increased. Accordingly, the sensitivity of the microphone 800 may be increased.

Although in the above-described example embodiments the resonator array is described to include a plurality of resonators having different center frequencies, the present disclosure is not limited thereto. Accordingly, for example, at least some of the resonators forming the resonator array may have the same center frequency or the resonator array may include only a single resonator.

According to the above-described example embodiments, since the cover member covers the otherwise open portion of the cavity formed in the substrate, the pressure gradient between the upper portion and the lower portion of the resonator array may be increased, and thus the displacements of the resonators may be increased. Accordingly, the sensitivity of the microphone may be increased. Furthermore, since the fixing member fixes one end portion of the resonator array and simultaneously covers the otherwise open portion of the cavity, the displacements of the resonators may be increased by the coupling effect, and the pressure gradient between the upper portion and the lower portion of the resonator array may be increased. Accordingly, the sensitivity of the microphone may be further increased.

It should be understood that exemplary embodiments described herein should be considered in a descriptive sense only and not for purposes of limitation. Descriptions of features or aspects within each example embodiment should typically be considered as available for other similar features or aspects in other example embodiments.

While one or more example embodiments have been described with reference to the figures, it will be understood by those of ordinary skill in the art that various changes in form and details may be made therein without departing from the spirit and scope as defined by the following claims.

What is claimed is:

1. A directional microphone comprising:

a substrate comprising a cavity that penetrates therethrough, the cavity comprising a first portion and a second portion, wherein the first portion and the second portion, together, comprise an entirety of the cavity;

a resonator array comprising a plurality of resonators, wherein the resonator array covers the first portion of the cavity; and a cover member covering at least a part of the second portion of the cavity, wherein the plurality of resonators have different center frequencies, and wherein the cover member is disposed on the same plane as the plurality of resonators and comprises a thin film.

2. The directional microphone of claim 1, wherein one end portion of each of the plurality of resonators is a fixed portion fixed to the substrate.

3. The directional microphone of claim 2, wherein each of the plurality of resonators comprises:

the fixed portion fixed to the substrate;

a movable portion extending from the fixed portion and moveable in response to an acoustic signal; and a sensing portion configured to sense a movement of the movable portion.

4. The directional microphone of claim 2, wherein the cover member covers an entirety of the second portion of the cavity.

5. The directional microphone of claim 1, further comprising:

a fixing member covering at least a part of the second portion in the cavity;

wherein one end portion of each of the plurality of resonators is fixed to the fixing member.

6. The directional microphone of claim 5, wherein the fixing member comprises a thin film and moves in association with the plurality of resonators.

7. The directional microphone of claim 6, wherein the fixing member and the plurality of resonators comprise a same material.

8. The directional microphone of claim 5, wherein the fixing member and the cover member, together, cover an entirety of the second portion of the cavity.

9. A directional microphone comprising:

a substrate comprising a cavity that penetrates therethrough, the cavity comprising a first portion and a second portion, wherein the first portion and the second portion, together, comprise an entirety of the cavity;

a resonator array comprising a plurality of resonators, wherein the resonator array covers the first portion of the cavity; and a fixing member covering at least a part of the second portion of the cavity, wherein the plurality of resonators have different center frequencies, wherein one end portion of each of the plurality of resonators is fixed to the fixing member, and wherein the fixing member comprises a thin film and moves in association with the plurality of resonators.

10. The directional microphone of claim 9, wherein the fixing member covers an entirety of the second portion of the cavity.

11. The directional microphone of claim 9, further comprising a cover member covering at least a part of the second portion of the cavity.

12. The directional microphone of claim 11, wherein the cover member comprises a thin film.

13. The directional microphone of claim 11, wherein the cover member and the fixing member, together, cover an entirety of the second portion of the cavity.

14. A directional microphone comprising:

a substrate;

a resonator array comprising a plurality of resonators, each of the plurality of resonators comprising a fixed portion, a moveable portion moveable in response to an acoustic signal, and a sensing portion configured to sense a movement of the moveable portion;

a cavity penetrating entirely through the substrate and comprising a first portion covered by the resonator array and a second portion not covered by the resonator array, wherein the first portion and the second portion, together, comprise an entirety of the cavity; and a cover which covers at least a part of the second portion of the cavity, wherein the plurality of resonators have different center frequencies, wherein the cover comprises a fixing member, wherein one end portion of each of the plurality of resonators is fixed to the fixing member, and wherein the fixing member comprises a thin film and moves in association with the plurality of resonators.

15. The directional microphone of claim 14, wherein the cover further comprises a cover member, and the cover member and the fixing member, together, cover an entirety of the second portion of the cavity.

* * * * *